US007708344B1

(12) United States Patent
Broering et al.

(10) Patent No.: US 7,708,344 B1
(45) Date of Patent: May 4, 2010

(54) PATIENT CHAIR WITH LOCKING ASSEMBLY

(75) Inventors: Jacob E. Broering, Yorkshire, OH (US); Leo R. Hanus, Tipp City, OH (US)

(73) Assignee: Midmark Corporation, Versailles, OH (US)

( * ) Notice: Subject to any disclaimer, the term of this patent is extended or adjusted under 35 U.S.C. 154(b) by 0 days.

(21) Appl. No.: 12/262,966

(22) Filed: Oct. 31, 2008

(51) Int. Cl.
*A47C 1/032* (2006.01)

(52) U.S. Cl. ..... 297/330; 297/354.12; 297/361.1; 297/362.13; 297/374; 297/376

(58) Field of Classification Search ..... 297/330, 297/354.1, 354.12, 354.13, 361.1, 362.13, 297/374, 375, 376
See application file for complete search history.

(56) References Cited

U.S. PATENT DOCUMENTS

| | | | | | |
|---|---|---|---|---|---|
| 27,521 | A | * | 3/1860 | Carman | 297/376 |
| 2,290,672 | A | * | 7/1942 | Cantor | 297/374 |
| 3,342,527 | A | * | 9/1967 | Bencene | 297/354.12 X |
| 3,823,979 | A | | 7/1974 | Davis, Sr. | |
| 3,984,146 | A | | 10/1976 | Krestel et al. | |
| 4,211,451 | A | | 7/1980 | Shephard | |
| 4,344,649 | A | * | 8/1982 | Fleischer | 297/354.12 X |
| 4,372,609 | A | * | 2/1983 | Boisset | 297/354.12 X |
| 4,386,805 | A | * | 6/1983 | Boisset | 297/354.12 X |
| 4,402,546 | A | * | 9/1983 | Johnson | 297/374 |
| 4,516,805 | A | | 5/1985 | Leeper et al. | |
| 4,552,403 | A | | 11/1985 | Yindra | |
| 4,572,573 | A | * | 2/1986 | Yoshikawa et al. | 297/330 X |
| 4,761,000 | A | | 8/1988 | Fisher et al. | |
| 5,074,621 | A | * | 12/1991 | McDonald | 297/440.15 |
| 5,131,717 | A | | 7/1992 | Kaminiski et al. | |
| 5,190,349 | A | | 3/1993 | Austin, Jr. et al. | |
| 5,348,372 | A | * | 9/1994 | Takamatsu et al. | 297/354.12 X |
| 5,511,852 | A | * | 4/1996 | Kusiak et al. | 297/383 X |
| 6,000,757 | A | * | 12/1999 | Sovis | 297/330 X |
| 6,106,065 | A | * | 8/2000 | Carroll | 297/330 |
| 6,382,725 | B1 | * | 5/2002 | Carroll | 297/330 |
| 6,644,743 | B1 | * | 11/2003 | Lin | 297/374 X |
| 7,090,240 | B2 | * | 8/2006 | Papac | 297/325 X |
| 7,600,817 | B2 | * | 10/2009 | Kramer et al. | 297/362.13 |
| 2002/0140269 | A1 | * | 10/2002 | Laverdiere et al. | 297/374 |
| 2002/0148044 | A1 | | 10/2002 | Hayes et al. | |
| 2003/0071503 | A1 | | 4/2003 | Brockway et al. | |
| 2005/0017561 | A1 | * | 1/2005 | Burmeister et al. | 297/354.12 |
| 2005/0156453 | A1 | | 7/2005 | Lin | |

OTHER PUBLICATIONS

US Patent and Trademark Office; Search Report and Written Opinion in International Patent Application No. PCT/US2009/052096 dated Sep. 15, 2009.

(Continued)

*Primary Examiner*—Rodney B White
(74) *Attorney, Agent, or Firm*—Wood, Herron & Evans, LLP

(57) ABSTRACT

A patient chair for use in a dental operatory or the like generally comprises a base, a chair frame supported by the base, and a seatback support coupled to the chair frame. The seatback support is slidably movable relative to the chair frame. To provide a desired connection or fit between components, a locking assembly is configured to apply a clamping force between the seatback support and the chair frame.

16 Claims, 4 Drawing Sheets

OTHER PUBLICATIONS

US Patent and Trademark Office; Search Report and Written Opinion in International Patent Application No. PCT/US2009/052104 dated Sep. 15, 2009.

US Patent and Trademark Office; Search Report and Written Opinion in International Patent Application No. PCT/US2009/052066 dated Sep. 3, 2009.

* cited by examiner

PATIENT CHAIR WITH LOCKING ASSEMBLY

This application is related to the following U.S. patent applications, each assigned to the Assignee of the present application:

U.S. patent application Ser. No. 12/262,887, filed Oct. 31, 2008;

U.S. patent application Ser. No. 12/262,995, filed Oct. 31, 2008;

U.S. Design application Ser. No. 29/327,186, filed Oct. 31, 2008; and

U.S. Design application Ser. No. 29/327,189, filed Oct. 31, 2008.

TECHNICAL FIELD

The present invention relates generally to chairs for supporting a patient during examinations and treatments, and more particularly to a chair for use in a dental operatory.

BACKGROUND

Conventional dental operatories generally include an articulating dental chair for supporting a patient in a variety of positions to facilitate the performance of dental procedures and operations. For example, dental chairs are generally adapted to be raised and lowered relative to a floor surface, and to be moved between a first orientation where a back cushion is inclined relative to a seat cushion to support the patient in a seated position, and a second orientation where the seat cushion is reclined to support the patient in a generally supine position.

In some dental chairs, the seat cushion is supported by a chair frame and the back cushion is coupled to an upright support that moves relative to the chair frame along a predetermined path or track (i.e., the support does more than merely pivot with respect to the chair frame). This upright support is sometimes referred to as a "carriage." A lower portion of the carriage is typically received between sidewalls of the chair frame. The carriage slides relative to the chair frame between the sidewalls and along the predetermined path to move the dental chair between the first and second orientations mentioned above.

One of the challenges associated with this type of dental chair relates to coupling the carriage to the chair frame. The carriage should be coupled (i.e., connected) to the chair frame in a manner that allows movement between the first and second orientations without a significant amount of "slop" or "play" between the components. In other words, the carriage should remain relative stable relative to the chair frame as the seatback is moved through its range of motion (both from the first orientation to the second orientation and vice-versa).

To address this concern, manufacturers may design the carriage, chair frame, and various other associated components to have relatively tight tolerances. For example, the lower portion of the carriage may be received between the sidewalls of the chair frame with little clearance. However, designing components with relatively tight tolerances increases the potential for poor fits or mismatches between the components.

Therefore, a dental chair that provides an improved fit between a carriage and a chair frame without requiring relatively small tolerances is highly desirable.

SUMMARY

A chair for supporting a patient during examinations or treatments is described below. The chair is particularly suited for use in a dental operatory, although the invention is not so limited.

In one embodiment, the chair generally comprises a base, a chair frame supported by the base, and a seatback support (or "carriage") coupled to the chair frame. The seatback support is slidably movable relative to the chair frame. To provide a "close fit" or proper connection between components, a locking assembly is configured to apply a clamping force between the seatback support and the chair frame.

In another embodiment, the chair frame includes first and second sidewalls. The seatback support has a lower portion received between the first and second sidewalls, and the locking assembly is associated with one of the first or second sidewalls. The locking assembly includes an engagement member coupled to the lower portion of the seatback support, a clamp plate facing an outer surface of the associated first or second sidewall, and a fastener having a head portion retained against the clamp plate and a shaft portion extending through the clamp plate and first or second sidewall. The shaft portion has threads for engaging the engagement member.

In yet another aspect or embodiment, the chair further includes a drive mechanism supported by the chair frame and coupled to the seatback support. The drive mechanism is configured to slidably move the seatback support relative to the chair frame. In some embodiments, the drive mechanism is a one-way hydraulic cylinder configured to move the seatback support from a reclined position to an upright position relative to the chair frame.

DETAILED DESCRIPTION

Figure 1:
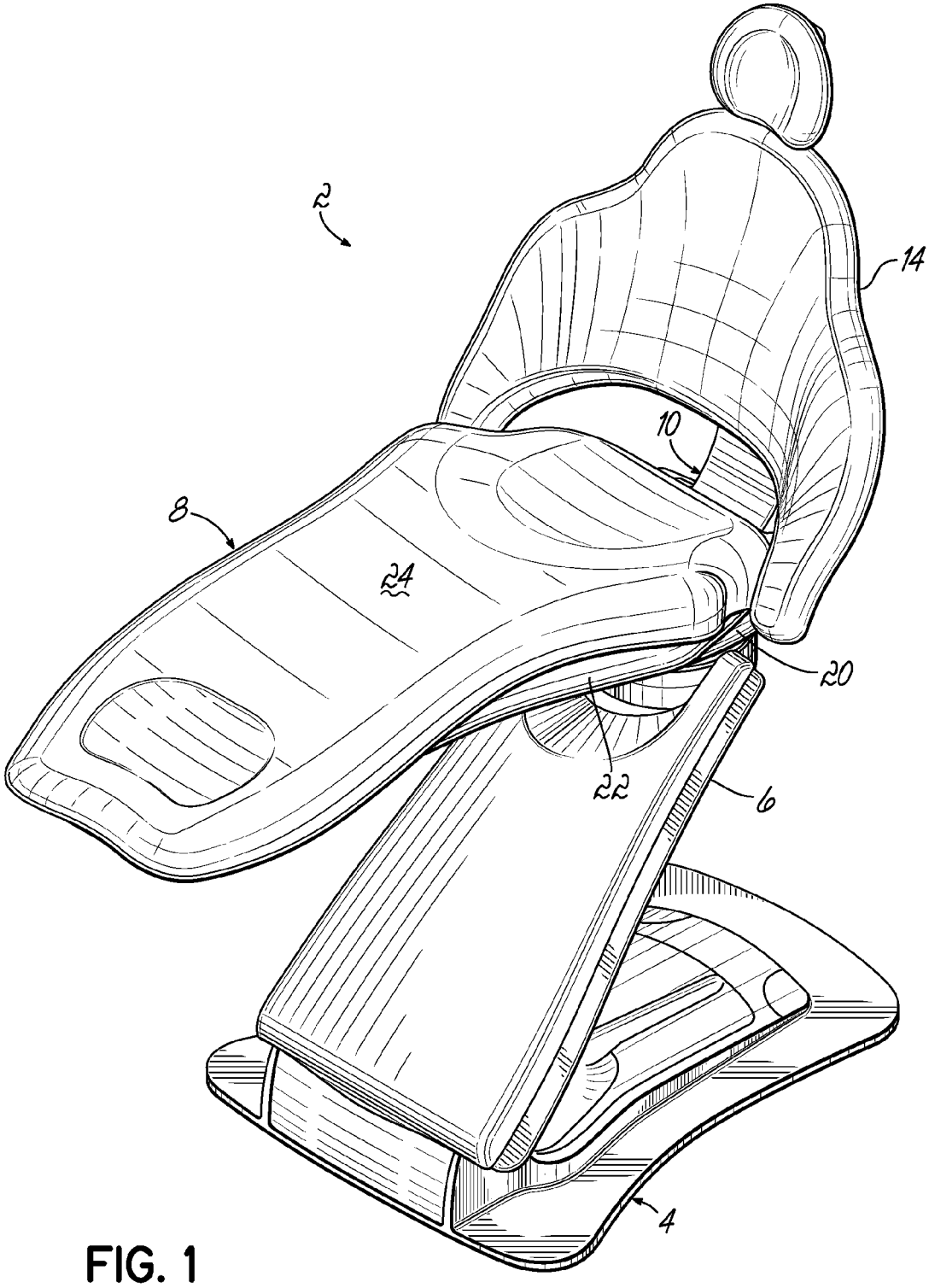
FIG. 1 is a perspective view of a chair according to one embodiment for supporting a patient during examinations or treatments.

FIG. 1 shows one embodiment of a chair 2 for supporting a patient during medical examinations, treatments, or the like. The type of examinations and treatments may vary such that chair 2 may be used by many different types of practitioners. For example, chair 2 may be used as part of a dental operatory to support a patient during dental procedures. To this end (and in a manner not shown herein), chair 2 may be used in combination with any of the components typically associated with a dental operatory, such as: a dental delivery unit or tray that supports various instruments and tools, a cuspidor that permits patients to expel the contents of their mouths, an adjustable lamphead that illuminates the treatment area, and various other devices useful for the performance of dental procedures.

Chair 2 generally comprises base 4, a lift arm 6 extending upwardly from base 4, and a seat assembly 8 supported by lift arm 6. Lift arm 6 raises and lowers seat assembly 6 relative to base 4. A seatback support 10 (referred to as a "carriage") extends generally upwardly from seat assembly 8 for supporting a seatback frame 12 (FIG. 2) and a back cushion 14 mounted to seatback frame 12. As will be described in greater detail below, chair 2 can move from the generally upright position/orientation shown in FIG. 1 to a generally reclined position/orientation.

Figure 2:
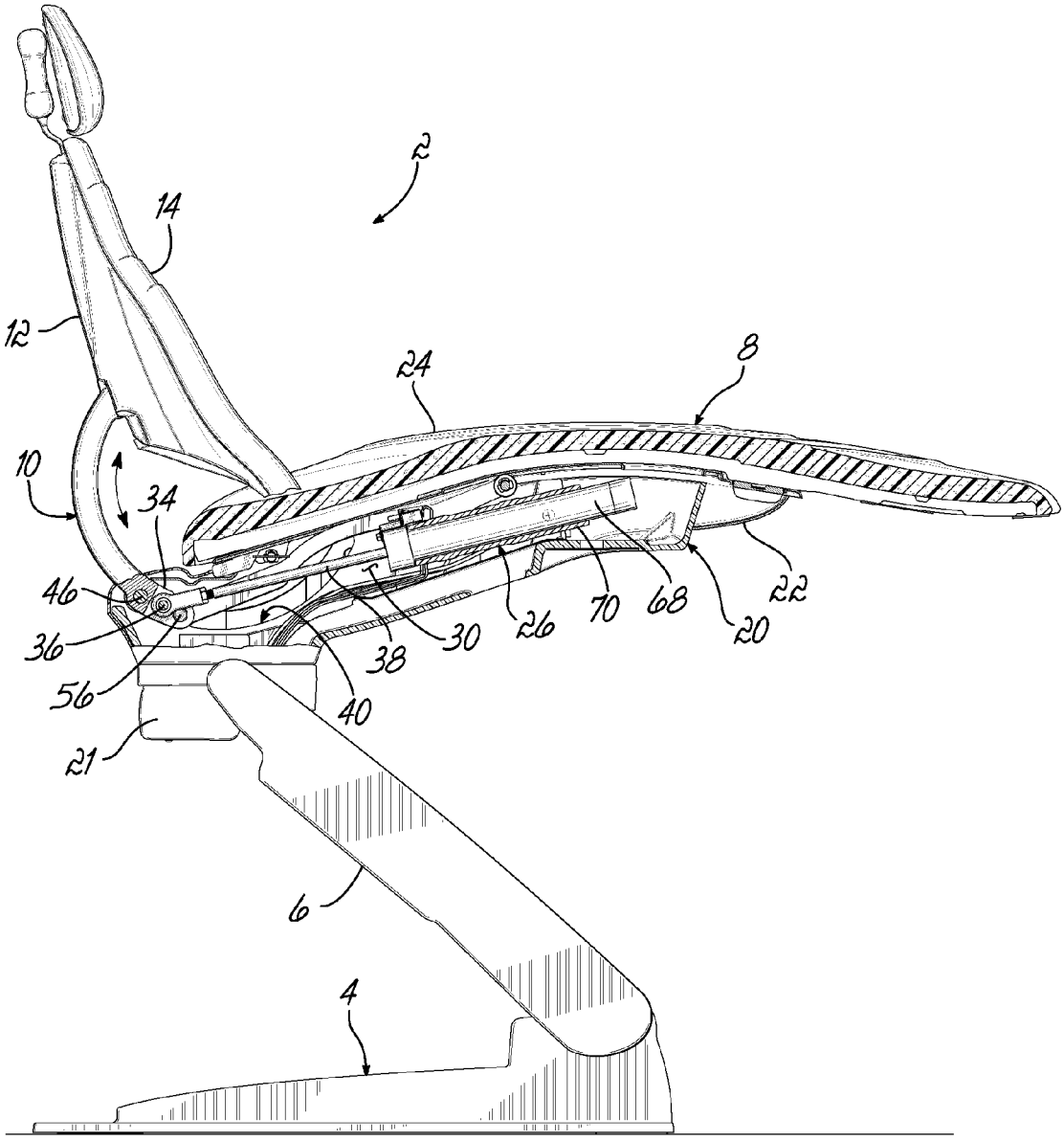
FIG. 2 is a side elevational view, partially in cross-section, of the chair shown in FIG. 1.
Figure 3:
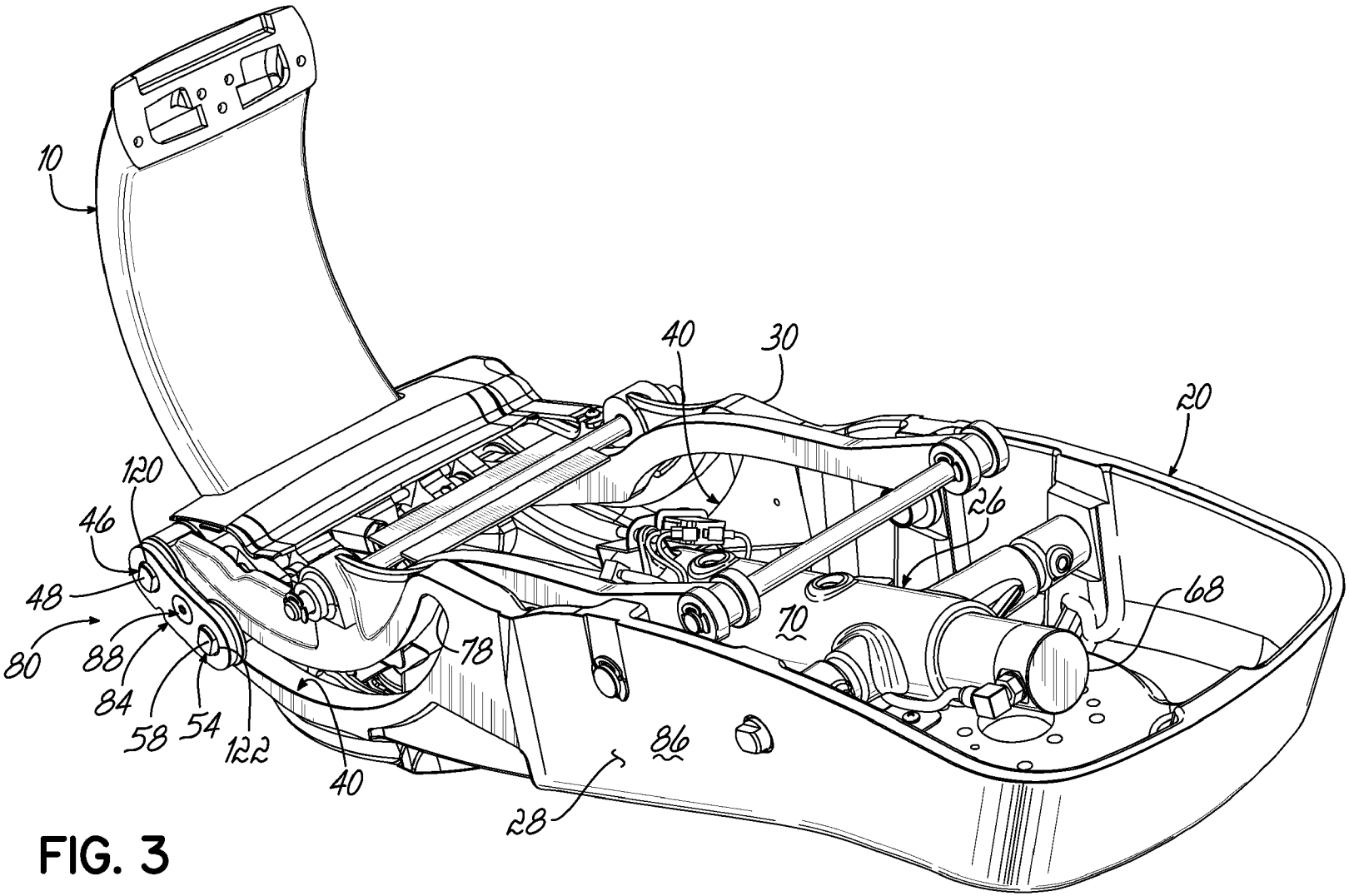
FIG. 3 is another perspective view of the chair shown in FIG. 1 with various components removed for clarity.

In one embodiment, seat assembly 8 includes a chair frame 20 mounted to lift arm 6 by a seat mount assembly 21, a casing assembly 22 mounted to chair frame 20, and a seat cushion 24 positioned over chair frame 20 and casing assembly 22. FIGS. 2 and 3 illustrate chair frame 20 and seatback support 10 in further detail. Chair frame 20 supports a drive mechanism 26 between first and second sidewalls 28, 30. Drive mechanism 26 is configured to slide seatback support 10 relative to chair frame 20 along a predetermined path to move chair 2 between a generally upright position (FIG. 2; corresponding to a seated position of the patient) and a generally reclined position (not shown; corresponding to a generally supine position of the patient). To this end, seatback support 10 includes a lower portion 34 received between the first and second sidewalls 28, 30. Drive mechanism 26 is connected to a support shaft 36 extending through lower portion 34. More specifically, drive mechanism 26 includes a piston rod 38 connected to support shaft 36 for applying a linear force to lower portion 34 of seatback support 10. When this force is applied, lower portion 34 is guided through an arcuate path defined by arcuate tracks 40 in the first and second sidewalls 28, 30.

Figure 4:
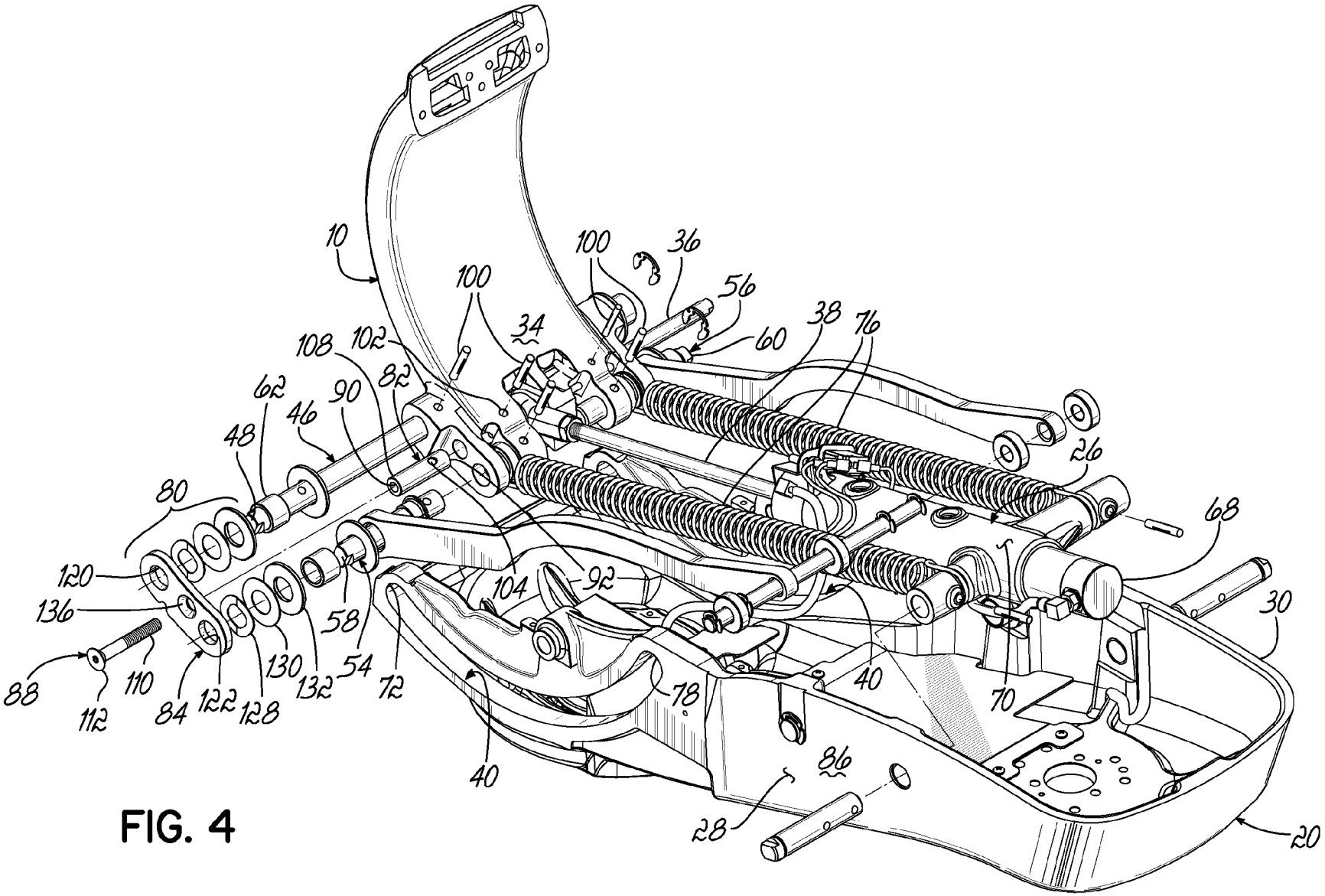
FIG. 4 is an exploded perspective view of the components of the chair shown in FIG. 3.

FIG. 4 illustrates the components that guide seatback support 10 through this motion in further detail. As shown in FIG. 4, a first guide shaft 46 extends through lower portion 34 of seatback support 10 behind (i.e., proximal of) support shaft 36. First guide shaft 46 includes a first end portion 48 that extends through arcuate track 40 of first sidewall 28 and a second end portion (not shown) that extends through arcuate track 40 of second sidewall 30. Second and third guide shafts 54, 56 are substantially aligned along a common axis and extend partially through lower portion 34 of seatback support 10 in front of (i.e., distal of) support shaft 36. Second guide shaft 54 includes an end portion 58 extending through arcuate track 40 of first sidewall 28, and third guide shaft 56 includes an end portion 60 extending through arcuate track 40 of second sidewall 30. Bushings 62 and/or bearings (not shown) may be provided on each of the end portions 48, 58, 60 to facilitate movement through the associated arcuate track 40. It will be appreciated, however, that various other structure may alternatively be used to facilitate movement of the respective portions of guide shafts 46, 54, 56 through the arcuate tracks 40. As can be appreciated, first, second, and third guide shafts 46, 54, 56 cooperate with arcuate tracks 40 to translate the linear forces applied by piston rod 38 to seatback support 10 into arcuate motion.

The drive mechanism 26 shown in FIG. 4 includes a one-way hydraulic cylinder 68 positioned within a housing 70 (referred to as a "trunnion") pivotally mounted to chair frame 20. Piston rod 38 thus applies force in a single direction. In the embodiment shown, piston rod 38 applies a pushing force to move lower portion 34 of seatback support 10 toward a rearward end 72 of each arcuate track 40. The rearward position shown in FIGS. 2-4 corresponds to the generally upright position of chair 2.

When the force of drive mechanism 26 is released, one or more return springs 76 pull support shaft 36 and lower portion 34 of seatback support 10 toward a forward end 78 of each arcuate track 40. Again, the first, second, and third guide shafts 46, 54, 56 cooperate with arcuate tracks 40 to translate the applied forces into arcuate motion. Those skilled in the art will appreciate that this arrangement is merely one example of how seatback support 10 may slide relative to chair frame 20. Indeed, chair 2 may alternatively include a two-way hydraulic cylinder, a mechanical linear actuator, or any other type of drive mechanism 26 for moving seatback support 10 relative to chair frame 20.

Now referring to FIGS. 3 and 4, chair 2 further includes a locking assembly 80 associated with first sidewall 28. Locking assembly 80 includes an engagement shaft 82 coupled to seatback support 10, a clamp plate 84 facing an outer surface 86 of first sidewall 28, and a fastener 88. Engagement shaft 82 is substantially aligned along the same axis as support shaft 36 and includes a bore 90 for receiving an end portion 94 of support shaft 36 at a first end 92 of engagement shaft 82. First end 92 is coupled to both support shaft 36 and lower portion 34 of seatback support 10 by a fastener 100 extending through holes 102, 104. At a second end 108 of engagement shaft 82, bore 90 is threaded and configured to receive a shaft portion 110 of fastener 88. More specifically, fastener 88 includes a head portion 112 retained against clamp plate 84 and a shaft portion 110 that extends through clamp plate 84 and first sidewall 28 to engage bore 90. Fastener 88 may be, for example, a flat head screw.

In one embodiment, clamp plate 84 further includes a first clearance hole 120 substantially aligned with the axis of first guide shaft 46 and a second clearance hole 122 substantially aligned with the axis of second and third guide shafts 54, 56. The end portions 48, 58 of the first and second guide shafts 46, 54 extend through the respective clearance holes 120, 122 when locking assembly 80 is installed. Various spacing components may be provided over first and second guide shafts 46, 54 between first sidewall 28 and clamp plate 84. For example, as shown in FIG. 4, a wave spring washer 128, a flat steel washer 130, and a Delrin washer 132 may be provided over each guide shaft 46, 54, 56 between clamp plate 84 and outer surface 86 of first sidewall 28.

To assemble chair 2, seatback support 10 is positioned between the first and second sidewalls 28, 30 of chair frame 20 and guide shafts 46, 54, 56 are positioned with their end portions 48, 58, 60 in the associated arcuate track 40. At this point, there may be a small amount of "play" between seatback support 10 and chair frame 20. To provide a more stable arrangement, clamp plate 84 is positioned with clearance holes 120, 122 over the respective end portions 48, 58 of first and second guide shafts 46, 54. Shaft portion 110 of fastener 88 is inserted through a central hole 136 in clamp plate 84 and into bore 90 of engagement shaft 82. Fastener 88 is then tightened (i.e., rotated) to engage shaft portion 110 with the threads of bore 90 thereby pulling seatback support 10 toward first sidewall 28. Because head portion 112 of fastener 88 is retained against the clamp plate 84, locking assembly 80 applies a clamping force between seatback support 10 and first sidewall 28. This clamping force maintains a relatively stable connection between seatback support 10 and chair frame 20 so as to eliminate "slop" during the movement of seatback support 10 between the generally upright position and the generally reclined position.

As can be appreciated, locking assembly 80 reduces or eliminates the need to design the seatback support 10 and chair frame 20 with relatively tight tolerances. There may be a fair amount of play when the components are first assembled, but the play is eliminated when locking assembly 80 is tightened. This may be a one-time step performed when chair 2 is first assembled. Casing assembly 22 (FIG. 1) and/or seat cushion 24 may be assembled over locking assembly 80 after the initial adjustments are made to conceal locking assembly 80. Alternatively, locking assembly 80 may be adjusted as needed whenever seatback support 10 begins show signs of "slop."

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. For example, engagement shaft 82 may be replaced with any suitable structural component coupled to lower portion 34 of seatback support 10 and configured engage fastener 88. Indeed, it will be appreciated that other components of locking assembly 80 described with specificity above may be replaced with other structural elements capable of performing similar functions. Additionally, although chair 2 only includes a single locking assembly 80, an additional locking assembly (not shown) may be associated with second sidewall 30 if desired.

The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A chair for supporting a patient during examination or treatment, comprising:

a base;

a seat frame supported by the base and including first and second sidewalls;

a seatback support coupled to the seat frame and slidably movable relative thereto, the seatback support having a lower portion received between the first and second sidewalls; and a locking assembly associated with one of the first or second sidewalls and being configured to apply a clamping force between the seatback support and the seat frame;

wherein the first sidewall has an outer surface and the locking assembly is associated with the first sidewall, the locking assembly including an engagement member coupled to the lower portion of the seatback support, a clamp plate facing the outer surface of the first sidewall, and a fastener having a head portion retained against the clamp plate and a shaft portion extending through the clamp plate and first sidewall, the shaft portion having threads for engaging the engagement member.

2. The chair of claim 1, wherein the engagement member is an engagement shaft coupled to the lower portion of the seatback support, the engagement shaft having a threaded bore for receiving the shaft portion of the fastener.

3. The chair of claim 1, wherein the engagement shaft is hollow and extends partially through the lower portion of the seatback support, the chair further comprising:

a support shaft extending from the second sidewall and partially through the lower portion of the seatback support, the support shaft being aligned along substantially the same axis as the engagement shaft and partially received therein.

4. A chair for supporting a patient during examination or treatment, comprising:

a base;

a seat frame supported by the base and including first and second sidewalls, each of the first and second sidewalls defining an arcuate track;

a seatback support having a lower portion coupled to the seat frame;

a drive mechanism supported by the seat frame and coupled to the seatback support, the drive mechanism configured to slidably move the seatback support relative to the seat frame;

a locking assembly associated with the first sidewall and configured to apply a clamping force between the seatback support and the first sidewall; and one or more guide shafts each extending through the lower portion of the seatback support and the arcuate track in at least one of the first and second sidewalls, the guide shafts being configured to travel along the associated arcuate tracks to guide movement of the seatback support between a generally reclined position and a generally upright position when the drive mechanism moves the seatback support.

5. The chair of claim 4, wherein the drive mechanism comprises a one-way hydraulic cylinder configured to move the seatback support from a generally reclined position to a generally upright position relative to the chair frame.

6. A chair for supporting a patient during examination or treatment, comprising:

a base;

a seat frame supported by the base and including first and second sidewalls;

a seatback support having a lower portion coupled to the seat frame;

a drive mechanism supported by the seat frame and coupled to the seatback support, the drive mechanism configured to slidably move the seatback support relative to the seat frame; and a locking assembly associated with the first sidewall and configured to apply a clamping force between the seatback support and the first sidewall;

wherein the first sidewall has an inner surface and outer surface, the locking assembly including an engagement member coupled to the lower portion of the seatback support, a clamp plate facing the outer surface of the first sidewall, and a fastener having a head portion retained against the clamp plate and a shaft portion extending through the clamp plate and first sidewall, the shaft portion having threads for engaging the engagement member.

7. The chair of claim 6, wherein the engagement member is an engagement shaft coupled to the lower portion of the seatback support, the engagement shaft having a threaded bore for receiving the shaft portion of the fastener.

8. The chair of claim 6, wherein the engagement shaft is hollow and extends partially through the lower portion of the seatback support, the chair further comprising:

a support shaft extending from the second sidewall and partially through the lower portion of the seatback support, the support shaft being aligned along substantially the same axis as the engagement shaft and partially received therein.

9. The chair of claim 8, wherein each of the first and second sidewalls defines an arcuate track, and wherein the drive mechanism comprises a hydraulic cylinder having a rod coupled to the support shaft for moving the seatback support relative to the seat frame, the chair further comprising:

one or more guide shafts each extending through the lower portion of the seatback support and partially received in the arcuate track of at least one of the first and second sidewalls, the guide shafts being configured to travel along the associated arcuate tracks to guide movement of the seatback support when the rod of the hydraulic cylinder moves the support shaft.

10. A chair for use in a dental operatory to support a patient during examination or treatment, comprising:

a base;

a lift arm supported by the base;

a seat frame supported by the lift arm and configured to be raised and lowered relative to the base;

a seat cushion supported by the seat frame;

a seatback support having a lower portion coupled to the seat frame, the seatback support being slidably movable relative to the seat frame;

a back cushion coupled to the seatback support; and a locking assembly configured to apply a clamping force between the seatback support and the seat frame;

the seat frame including first and second sidewalls, the seatback support having a lower portion received between the first and second sidewalls, and the locking assembly being associated with one of the first or second sidewalls.

11. The chair of claim 10, wherein the first sidewall has an outer surface and the locking assembly is associated with the first sidewall, the locking assembly including an engagement member coupled to the lower portion of the seatback support, a clamp plate facing the outer surface of the first sidewall, and a fastener having a head portion retained against the clamp plate and a shaft portion extending through the clamp plate and first sidewall, the shaft portion having threads for engaging the engagement member.

12. The chair of claim 11, wherein the engagement member is an engagement shaft coupled to the lower portion of the seatback support, the engagement shaft having a threaded bore for receiving the shaft portion of the fastener.

13. The chair of claim 11, wherein the engagement shaft is hollow and extends partially through the lower portion of the seatback support, the chair further comprising:

a support shaft extending from the second sidewall and partially through the lower portion of the seatback support, the support shaft being aligned along substantially the same axis as the engagement shaft and partially received therein.

14. The chair of claim 11, further comprising:

a casing coupled to the seat frame, at least a portion of the casing being positioned over the clamp plate to conceal the locking assembly.

15. The chair of claim 10, further comprising:

a drive mechanism supported by the seat frame and coupled to the seatback support, the drive mechanism configured to move the seatback support relative to the seat frame.

16. The chair of claim 15, wherein the drive mechanism comprises a one-way hydraulic cylinder.

* * * * *